US008456099B2

(12) United States Patent
Brückel et al.

(10) Patent No.: US 8,456,099 B2
(45) Date of Patent: Jun. 4, 2013

(54) METHOD FOR OPERATING A GAS DISCHARGE LAMP

(75) Inventors: Martin Brückel, Garching (DE); Simon Lankes, Falkensee (DE); Andre Nauen, Berlin (DE); Bernhard Reiter, München (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 1010 days.

(21) Appl. No.: 12/083,604

(22) PCT Filed: Oct. 12, 2006

(86) PCT No.: PCT/EP2006/067346

§ 371 (c)(1),
(2), (4) Date: Apr. 15, 2008

(87) PCT Pub. No.: WO2007/045599

PCT Pub. Date: Apr. 26, 2007

(65) Prior Publication Data

US 2009/0256491 A1 Oct. 15, 2009

(30) Foreign Application Priority Data

Oct. 17, 2005 (DE) ..... 10 2005 049 582

(51) Int. Cl.
*H05B 41/16* (2006.01)
*H05B 37/02* (2006.01)

(52) U.S. Cl.
USPC ..... 315/246; 315/291

(58) Field of Classification Search
USPC ..... 315/224, 246, DIG. 2, DIG. 4–DIG. 5, 315/209 R
See application file for complete search history.

(56) References Cited

U.S. PATENT DOCUMENTS

| | | | | |
|---|---|---|---|---|
| 5,583,396 | A | 12/1996 | Hideaki et al. | |
| 5,608,294 | A * | 3/1997 | Derra et al. | 315/224 |
| 6,232,725 | B1 * | 5/2001 | Derra et al. | 315/209 R |
| 6,586,892 | B2 * | 7/2003 | Derra et al. | 315/291 |
| 7,122,960 | B2 | 10/2006 | Tukamoto et al. | |
| 7,443,103 | B2 * | 10/2008 | Li et al. | 315/209 R |

(Continued)

FOREIGN PATENT DOCUMENTS

| | | |
|---|---|---|
| DE | 100 21 537 A1 | 11/2001 |
| EP | 1 150 336 A2 | 10/2001 |

(Continued)

OTHER PUBLICATIONS

English abstract for JP 2006173022 A.

(Continued)

*Primary Examiner* — Minh D A

(57) ABSTRACT

The invention relates to a method for operating a gas discharge lamp, in which the shape of at least one electrode of the gas discharge lamp is changed, in which by changing the lamp current for a predeterminable duration, at least one current pulse is generated such that structures which have grown on the at least one electrode are at least partially removed, the current pulse being generated for the duration of at least one entire half cycle of the AC voltage or the alternating current if the gas discharge lamp is fed AC voltage or alternating current, and the current pulse being generated with a pulse duration of between approximately 0.1 s and approximately 5 s if the gas discharge lamp is fed DC voltage or direct current.

11 Claims, 2 Drawing Sheets

U.S. PATENT DOCUMENTS

| | | | | |
|---|---|---|---|---|
| 7,598,678 | B2 * | 10/2009 | Harada et al. | 315/224 |
| 7,741,791 | B2 * | 6/2010 | Rahmane et al. | 315/291 |
| 2006/0028149 | A1 | 2/2006 | Brates et al. | |

FOREIGN PATENT DOCUMENTS

| | | | |
|---|---|---|---|
| EP | 1 309 228 | A2 | 5/2003 |
| EP | 1 408 723 | A2 | 4/2004 |
| JP | 2003151786 | A | 5/2003 |
| JP | 2004296427 | A | 10/2004 |
| JP | 2006173022 | A | 6/2006 |

OTHER PUBLICATIONS

English language abstract of JP 2003151786 A.

* cited by examiner

METHOD FOR OPERATING A GAS DISCHARGE LAMP

TECHNICAL FIELD

The present invention relates to a method for operating a gas discharge lamp, in which the shape of at least one electrode of the gas discharge lamp is changed for the purpose of producing optimum operating conditions, the gas discharge lamp being fed by an AC voltage or an alternating current or by a DC voltage or a direct current.

PRIOR ART

One general problem concerned with the operation of electric lamps, in particular gas discharge lamps such as HID (high intensity discharge) lamps, which are used, for example, for video projections, is the fact that structures grow on the two electrodes of these lamps over the course of the operating time. As a result, the operating voltage of such an HID lamp changes over the course of the lamp life. Back-burning of the electrodes increases the distance between the electrodes and therefore also the operating voltage of this HID lamp. The increase in the operating voltage may in this case be approximately 0.05 V per hour up to approximately 1 V per hour. The growth of such structures or such peak growth reduces the distance between the electrodes and, as a result, the operating voltage of the HID lamp is also reduced. In this case, typical values are approximately 1 V up to approximately 20 V within a duration of approximately 15 minutes up to a few hours. A typical profile for the operating voltage results by superimposing these two effects, which are provided, on the one hand, by the growth of these structures and, on the other hand, by the back-burning of the electrodes.

The operating voltage can generally be approximately 70 V for an HID lamp if this HID lamp is new and is still at zero operating hours. Owing to the abovementioned growth of such structures on the electrodes, there may be a reduction in the operating voltage to approximately 40 V up to approximately 60 V. Owing to the back-burning of the electrodes, a rise in the operating voltage up to approximately 130 V may take place over the course of the life of the electric lamp. As shown by this example, in this case it may arise, in particular, that the operating voltage in the first approximately 300 operating hours falls below the value which the electric lamp has when new, owing to such peak growth or such grown-on structures.

HID lamps are approximately temperature-dependent voltage sources, i.e. the temperature distribution in the so-called burner of the lamp determines the operating voltage. The lamp power is in this case set by the fact that, at a given lamp voltage, so much current is provided by an electronic ballast connected to the lamp that the lamp power corresponds to a desired value. In the case of light sources for video projections, the lamp power is regulated very precisely and only has a tolerance range in the region of a few percent. This is so that it is possible to control the lamp power of the projection system.

Electronic ballasts for HID lamps generally have a maximum possible output current. The maximum possible RMS (root mean square) value for the output current $I_{RMS_max}$ depends, inter alia, on the maximum permissible resistive heating of the components of the electronic ballast itself and of the surrounding environment in which the electronic ballast is located. In particular, this maximum possible resistive heating is dependent on a cooling system which may be provided for the electronic ballast.

Typical periods of time of a few minutes elapse before a new thermal equilibrium is established in the components in the event of a change in the output current $I_{RMS}$. If the output current changes for a short period of time, which is shorter than the time taken before a new thermal equilibrium is established, the heating of the components in this period of time is less than in the case of a permanent increase in the current by the same value. The maximum possible short-term current (for times shorter than those before the thermal equilibrium is established) is generally greater than the maximum possible current $I_{RMS_max}$. The maximum possible short-term current generally depends on other component properties than the maximum possible permanent current $I_{RMS_max}$. For example, the maximum possible short-term current depends on the maximum possible driving of inductances without them entering saturation. Furthermore, this maximum possible short-term current may depend on the maximum permissible peak current of semiconductor switches and diodes.

At a given lamp voltage, the maximum possible lamp power is dependent on the maximum possible output current $I_{RMS_max}$ of the electronic ballast. In the case of a given system comprising an HID lamp and an electronic ballast, the maximum possible lamp power in the first approximately 300 operating hours can be reduced by the operating voltage of the HID lamp being lowered by the growth of structures on the electrodes. As a result, the maximum possible lamp power of the system is reduced by the given maximum output current $I_{RMS_max}$ of the electronic ballast. As a result, in some cases it may arise that the HID lamp can no longer be operated at its rated power. In particular, it may arise that the HID lamp does not reach its rated operating temperature owing to the operation below its rated power. In turn, the lamp voltage is dependent on the temperature. In the conventional temperature range, it rises as the burner temperature increases. The effect of the growth of structures on the electrodes and the resultant operation at a lamp power which is too low can therefore also be increased further by the resultant temperature in the lamp interior which is too low. Overall, the growth of structures on the electrodes can accordingly result in the HID lamp running with undesirable operational parameters, in particular a lamp voltage which is too low (depending on the burner temperature and the distance between the structures which have grown on the electrodes) and therefore at a lamp power which is too low owing to the limited maximum output current $I_{RMS_max}$ of the electronic ballast.

In order to control the electrode shape, the German laid-open Specification DE 100 21 537 A1 has disclosed a method and an apparatus for operating a gas discharge lamp, in which a desirable growth of structures on the electrodes of a gas discharge lamp is intended to be achieved by the instantaneous power of the lamp being increased at certain time intervals, the values of at least one item of operational data of the lamp, which data change over time, being measured continuously or discontinuously, and the frequency of the AC voltage or the alternating current being selected as a function of the measured values. The transport processes taking place during operation of a gas discharge lamp are intended to be used in the known method for the purpose of growing structures in a targeted manner on the electrodes. In the known method, this takes place by the lamp frequency being varied. As a result of the controlled changing of the operating frequency, the transport phenomena are used for the attachment of material to the electrodes. In addition to the difference that, in the present invention, it is precisely the growth of such structures that is intended to be prevented or structures which have already grown on are intended to be removed, one further disadvantage of the known method can be seen in the fact that, in some projection applications (for example DLP), the lamp frequency is not freely selectable and therefore such electrode shaping cannot be carried out.

It is furthermore known to carry out a selection of burners after production in accordance with the criterion that the operating voltage is higher than a specific lower limit. However, in this case the lower limit is selected to be so high that the present problem of structures growing does not occur. One significant disadvantage, however, is in this case increased rejects during burner manufacture.

One further possibility consists in increasing the average operating voltage of a lamp type by means of a higher gas pressure for the filling. However, one disadvantage associated with this is the fact that the burner vessel needs to withstand a higher pressure and therefore either a better vessel is required or it is necessary to accept an increased number of rejects of cracked burner vessels with this lamp type.

Furthermore, it would also be possible, and is already known, to increase the maximum possible output current $I_{RMS_max}$ of the electronic ballast by using other components. For example, in this case transistors having a low drain/source resistance or inductances having a greater copper cross section or inductances having a higher degree of controllability or components having improved heat dissipation or larger heat sinks are used. However, one significant disadvantage in this case concerns the considerable costs and the very large electronic ballasts involved.

Furthermore, in this case it is also necessary to carry out severe cooling of the ballast, as a result of which larger and more expensive fans are required, which generate greater fan noise.

DESCRIPTION OF THE INVENTION

The present invention is based on the object of providing a method for operating a gas discharge lamp, with which method it is possible to change the shape of the electrodes of the gas discharge lamp in a safe and low-complexity manner. In particular, optimum operation of the gas discharge lamp should be made possible with improved life properties.

The object is achieved by a method having the features of patent claim 1.

In a method according to the invention for operating a gas discharge lamp, the shape of at least one electrode of the gas discharge lamp is changed during the operating time of the gas discharge lamp. The gas discharge lamp can be operated with AC voltage or with alternating current. However, it can also be operated with DC voltage or direct current. One important concept of the invention consists in the shape of at least one electrode being influenced by the fact that at least one current pulse is generated by the lamp current being changed for a predeterminable duration. In this case, the current pulse is produced such that structures which have grown on the at least one electrode of the gas discharge lamp are at least partially removed, the current pulse being generated for the duration of at least one entire half cycle of the AC voltage or the alternating current if the gas discharge lamp is fed AC voltage or alternating current. The increase in the current and therefore the generation of the current pulse is in this case carried out over the duration of an entire half cycle, in particular over the duration of a plurality of half cycles. If the gas discharge lamp is fed DC voltage or direct current, the current pulse is generated for a duration of approximately 0.1 s to approximately 5 s. In the process, the mean value for the current is increased for this duration.

Owing to the generation of at least one current pulse over the corresponding duration of an entire half cycle by the lamp current being changed, structures which have grown on can be removed reliably and continuously on at least one electrode. The operating conditions of the gas discharge lamp and therefore also of the entire system in which the gas discharge lamp is arranged can be considerably improved and the life extended as a result. In the invention, an independent current pulse is therefore generated by increasing the lamp current instead of a short-term current increase, which is virtually placed on the alternating current, being carried out at the temporal end of a half cycle, as in the prior art from DE 100 21 537 A1.

Furthermore, the method according to the invention makes it possible for there to be uniform operation over a long duration. This is a significant advantage in particular in the case of HID lamps for projection systems since excessive growth of structures can be prevented virtually continuously and, as a result, the distance between the electrodes can be kept essentially unchanged. In turn, this has an advantageous effect on the continuity of the operating voltage and therefore on the entire operation of the gas discharge lamp.

The amplitude of the current pulse and/or the profile of the current pulse and/or the duration of the current pulse and/or the time at which the current pulse is generated is/are advantageously produced as a function of at least one operational parameter of the gas discharge lamp. A detected lamp voltage of the gas discharge lamp and/or a detected profile of this lamp voltage are preferably used as operational parameters. Furthermore, the amplitude of the current pulse and/or the profile of the current pulse and/or the duration of the current pulse and/or the time at which the current pulse is generated can preferably be produced as a function of a lamp voltage threshold value being exceeded or undershot.

The amplitude of the current pulse and/or the profile of the current pulse and/or the duration of the current pulse and/or the time at which the current pulse is generated can advantageously also be produced such that the structures which have grown on at least one electrode are removed and the current load on an electronic ballast connected to the gas discharge lamp can be kept low and remains essentially unchanged. The current pulse is therefore advantageously generated such that the grown-on structures are at least partially removed or grown-on peaks are melted and the current load or the thermal load on the electronic ballast or its components is low. Furthermore, the current pulse can also be generated such that the visible effect of the current pulses on the emitted light of the gas discharge lamp or the image of a projection unit is small and, in particular, cannot be perceived by an observer.

The duration of the current pulse is preferably in a time interval of between approximately 0.1 s and 10 s. The duration of the current pulse is preferably less than two seconds, in particular less than one second. Such short pulses with increased current may be enough to allow grown-on structures to be melted and, as a result, to bring about an increase in the operating voltage by up to approximately 20 V.

Provision may be made for, at least for a predeterminable duration, a peak value for the current pulse to be greater than a maximum permissible current value for an electronic ballast which is electrically connected to the gas discharge lamp.

In particular, the amplitude of the current pulse and/or the duration of the current pulse and/or the shape of the current pulse can be selected such that the electronic ballast is not heated to a greater extent than is permissible for the application. This makes it possible to prevent components of the electronic ballast being overloaded or being impaired in terms of their function or even destroyed.

Provision may preferably be made for the profile of the lamp voltage of the gas discharge lamp to be detected over the duration of the current pulse, and the amplitude of the current pulse and/or the profile of the current pulse and/or the duration of the current pulse to be generated as a function of the detected profile of the lamp voltage. As a result, it is possible to achieve a minimization of the load on an electronic ballast connected to the gas discharge lamp and to minimize a visible change in the emitted light from the gas discharge lamp.

The amplitude of the current pulse and/or the profile of the current pulse and/or the duration of the current pulse and/or the time at which the current pulse is generated is/are advantageously produced such that the rate of rise of the lamp voltage and/or the value for the lamp voltage once the duration of the current pulse has elapsed correspond to desired and requisite values. For example the amplitude of the current pulse can only be set so high that melting of the peaks or removal of the grown-on structures can still be achieved. Even this protects the electronic ballast and the gas discharge lamp and results in the emitted light from the gas discharge lamp being changed to a minimum extent. As a result, it is also possible to achieve a slow and controllable change in the lamp voltage. In turn, this makes it possible to control the lamp voltage which is set once the current pulse has been switched off or after the end of the duration of the current pulse in a more targeted manner.

Provision may advantageously be made for the current pulse to be generated during a runup phase of the gas discharge lamp. This is particularly advantageous since in this case changes in the emitted light from the gas discharge lamp and therefore in the image of the video projection apparatus are not perceived as being disruptive, since this could arise, for example, during the actual operation after runup.

The amplitude of the current pulse and/or the profile of the current pulse and/or the duration of the current pulse and/or the time at which the current pulse is generated is/are preferably produced as a function of a thermal load on an electronic ballast which is electrically connected to the gas discharge lamp.

Provision may be made for the electronic ballast to detect the lamp voltage and to preferably store the profile of the lamp voltage. The profile of this lamp voltage can also remain stored in the memory once the electronic ballast has been switched off. Storing the profile of the lamp voltage may also take place over several operating cycles of the gas discharge lamp. As the profile of the lamp voltage over time, on the one hand, the profile can be detected during the runup phase. It is also possible for the profile of the operating voltage over time to be detected after the runup phase. It is likewise possible for the profile of the lamp voltage to be detected during the operating phases before an operating phase which is currently being carried out if the gas discharge lamp and the electronic ballast were switched off in the meantime.

Provision may be made for a current pulse only to be generated when the measured lamp voltage is lower than a predeterminable limit value. Provision may also be made for the current pulse only to be produced when the measured profile of the lamp voltage indicates that the lamp voltage could in the future fall below a predeterminable limit value owing to grown-on structures. The limit value can in this case be selected such that the probability of a fall in the lamp voltage below a minimum value, in the case of which the electronic ballast changes over to a current-limitation mode, is less than or equal to a minimum probability value.

Provision may also advantageously be made for the electronic ballast connected to the gas discharge lamp to generate a desired value for ventilation of the electronic ballast during the generated current pulse, as a result of which it is made possible for, if necessary, a higher or a longer current pulse to be generated with uniform ventilation. The current pulse can therefore be generated as a function of the ventilation of the electronic ballast. The temperature of the electronic ballast or individual components can in this case be sensed, for example, via one or more temperature sensors.

If the gas discharge lamp is fed AC voltage or alternating current, the current pulse is generated and fed to the electrodes of the gas discharge lamp. In each case that electrode which then has the operating state of an anode experiences the effect of the current pulse, and the structures which have grown on the electrode are at least partially removed or melted away. That is to say the current pulse is applied to that electrode which at that point in time functions or is operated in the operating state as the anode. The current pulse is always applied to the first electrode at least for a half cycle when this electrode is operated as the anode and is always applied to the second electrode of the gas discharge lamp for at least one half cycle if the second electrode is operated as the anode. This makes it possible to achieve a situation in which the luminous efficiency of the electric lamp can be kept essentially constant over the periods of time in which no generation of a current pulse is carried out in comparison with the periods of time in which a current pulse is generated. There are therefore essentially no losses of power, as a result of which the luminous flux and therefore the light produced by the gas discharge lamp also do not fluctuate, which could be perceived by the human eye of a viewer. Furthermore, it is also possible to achieve a lower current load on the electronic ballast. The duration of a current pulse may be between approximately 100 ms and approximately 3 s. The current pulse is preferably applied to an electrode for approximately 10 to approximately 500 half cycles, it being possible for the operating frequency of the electric lamp to be between approximately 50 Hz and approximately 200 Hz.

BRIEF DESCRIPTION OF THE DRAWINGS

The present invention will be described in more detail below with reference to the attached drawings, in which.

PREFERRED EMBODIMENT OF THE INVENTION

Figure 1:
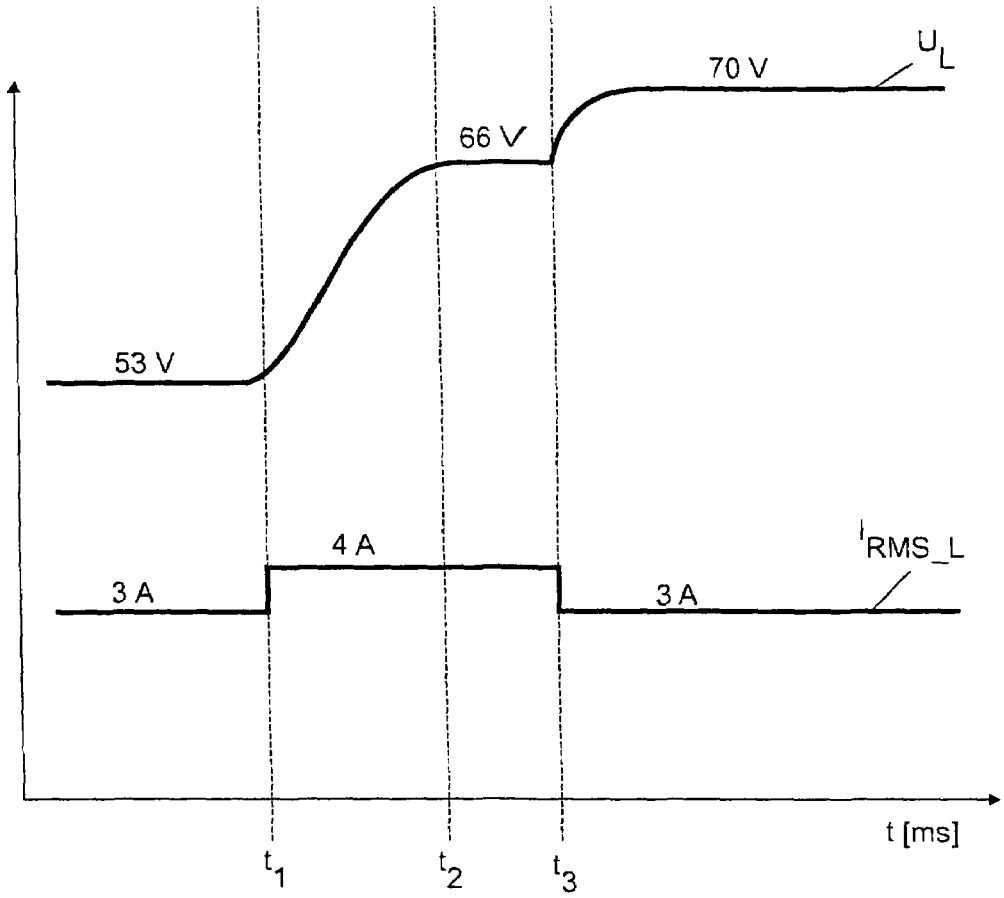
FIG. 1 shows a profile of a lamp voltage and a lamp current as a function of time.

The graph shown in FIG. 1 illustrates the profile of a lamp voltage $U_L$ of an HID lamp as a function of time. The graph likewise shows the profile of a current pulse $I_{RMS_L}$. In the exemplary embodiment shown, the HID lamp is fed AC voltage or alternating current. As can be seen in the graph, the lamp voltage up to time $t_1$ has an essentially constant value of approximately 53 V. The lamp current $I_{RMS_L}$ is likewise essentially constant up to time $t_1$ and, in the exemplary embodiment, has a value of approximately 3 A. At time $t_1$, the lamp current $I_{RMS_L}$ is increased and a current pulse is generated. As can be seen in this regard from the illustration in FIG. 1, the current pulse has a duration $t_3-t_1$. In the exemplary embodiment, this is a duration of approximately 600 ms. As can also be seen from FIG. 1, the RMS value of the current pulse is essentially constant over the entire duration $t_3-t_1$ and has a value of approximately 4 A in the exemplary embodiment.

At the beginning of the current pulse at time $t_1$, the operating voltage or the lamp voltage $U_L$ of the HID lamp also increases since the structures which have grown on the electrodes of the HID lamp have been melted by the current pulse.

As can be seen, the lamp voltage $U_L$ increases relatively severely only up to time $t_2$ and, even at this time $t_2$, reaches a value of approximately 66 V. In the duration between times $t_2$ and $t_3$, the lamp voltage $U_L$ does not increase any more or only increases to an insignificant extent. When the duration of the current pulse elapses at time $t_3$, and therefore the lamp current $I_{RMS_L}$ is again reduced to the value of approximately 3 A, the lamp voltage $U_L$ once again increases for a relatively short duration. As can be seen in FIG. 1, an end value of approximately 70 V is reached in this case in the exemplary embodiment.

Figure 2:
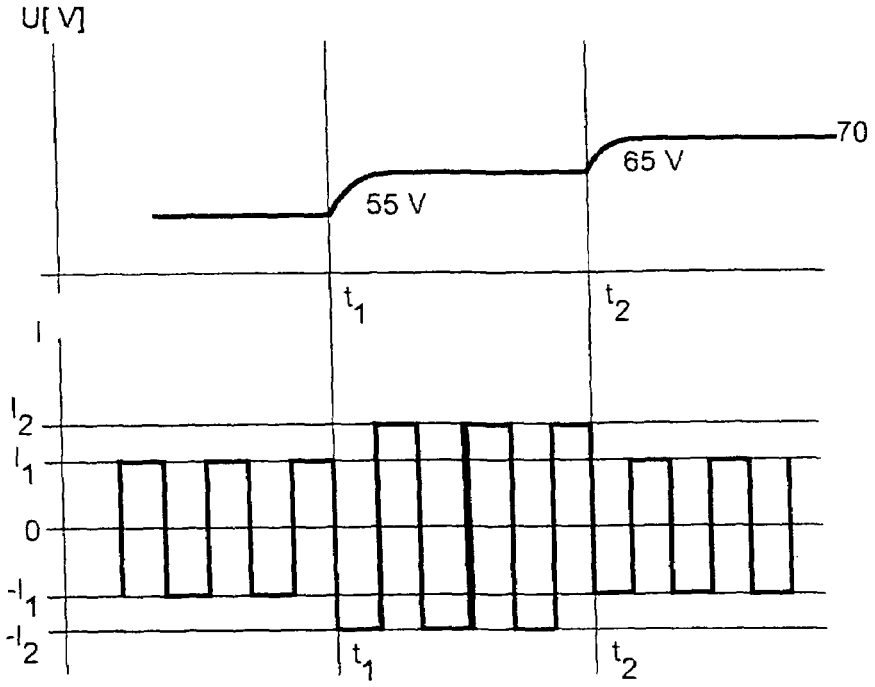
FIG. 2 shows a second profile of a lamp voltage and a lamp current as a function of time.

FIG. 2 illustrates a further profile of the lamp voltage $U_L$ and of the lamp current I. The figure shows, by way of example, an illustration with a plurality of half cycles, in this case the lamp current I being between the values $I_1$ and $-I_1$ of the lamp current in the time interval between times 0 and $t_1$, depending on the respective half cycle. At time $t_1$, the lamp current I is increased, and a current pulse is generated. It can be seen in FIG. 2 that the current pulse is generated for a duration $t_2-t_1$ and over a plurality of half cycles. The increase in the lamp current takes place such that the current amplitudes of the current pulse are $I_2$ or $-I_2$, depending on the half cycle. At time $t_2$, the current pulse is ended again and the lamp current is again reduced to the maximum amplitude values $I_1$ and $-I_1$.

Figure 3:
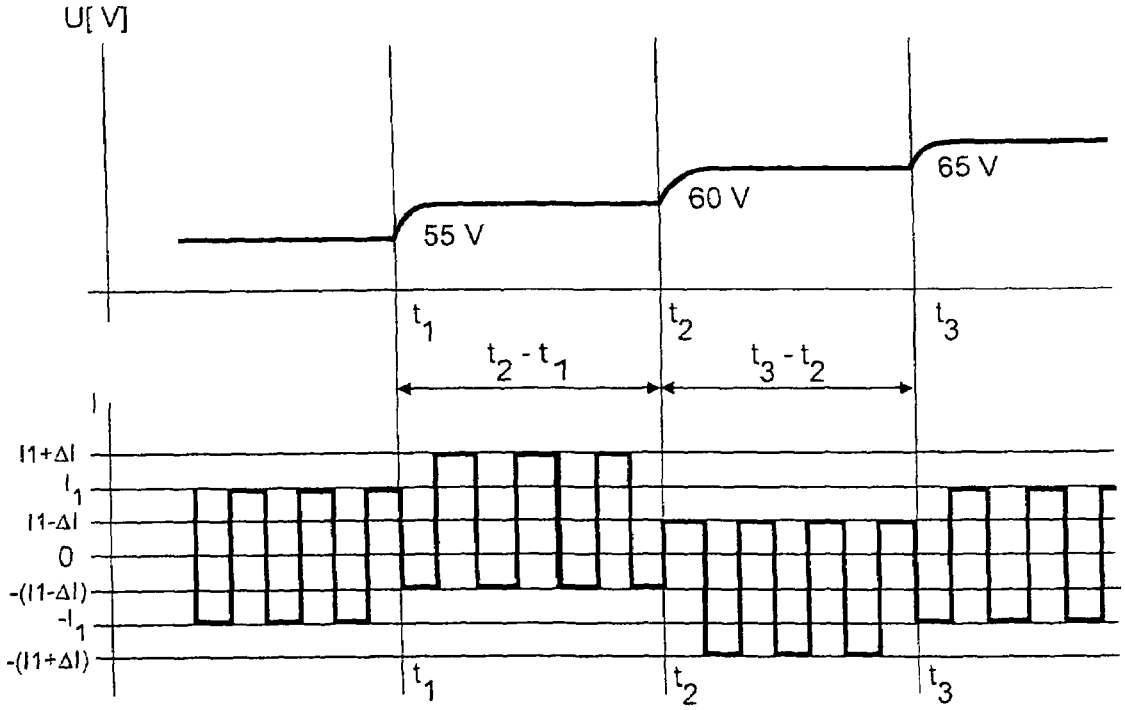
FIG. 3 shows a third profile of a lamp voltage and a lamp current as a function of time.

FIG. 3 shows a further exemplary embodiment of the method according to the invention. In FIG. 3, a current pulse is generated which is present for at least one half cycle in each case at that electrode of the HID lamp which at that time and for the corresponding duration is operated as the anode. As FIG. 3 shows in this regard, the lamp current is again set in the time interval between times 0 and $t_1$ such that the amplitudes have the values $I_1$ and $-I_1$, depending on the respective half cycle. At time $t_2$, the lamp current is increased by $\Delta I$ (current pulse). Between times $t_1$ and $t_2$, a current pulse is therefore generated over a plurality of half cycles and is applied to that electrode (first electrode) of the HID lamp which is operated as the anode in this duration. In this duration, the lamp current has amplitude values of $I_1+\Delta I$ and $-(I_1-\Delta I)$. In the duration between times $t_2$ and $t_3$, the lamp current is set such that the current pulse generated over a plurality of half cycles is present at the second electrode, which in this duration is operated as the anode. In this duration $t_3-t_2$, the lamp current has amplitude values of $I_1-\Delta I$ and $-(I_1+\Delta I)$. As can be seen, the lamp power ($P=U*I$) is approximately of equal value in durations $t_2-t_1$ and $t_3-t_2$, the mentioned time intervals being approximately equal in length. At time $t_3$, the current pulse is ended, and the lamp current is set according to the time interval $t_1-0$.

However, the invention is not restricted to the application of gas discharge lamps which are fed AC voltage or alternating current. Instead, the principle of a sufficiently long generation of a current pulse can also be applied to a gas discharge lamp which is fed DC voltage or direct current. It is important here that the current pulse is generated for a duration which is between 0.1 s and 5 s, or that the direct current, in particular the mean value, is increased for such a duration.

The invention claimed is:

1. A method for operating a gas discharge lamp, in which the shape of at least one electrode of the gas discharge lamp is changed, wherein in this process by changing the lamp current for a predeterminable duration, at least one current pulse is generated such that structures which have grown on the at least one electrode are at least partially removed, the current pulse being generated for the duration of at least one entire half cycle of the AC voltage or the alternating current if the gas discharge lamp is fed AC voltage or alternating current, or the current pulse being generated with a pulse duration of between approximately 0.1 s and approximately 5 s if the gas discharge lamp is fed DC voltage or direct current, wherein the electrical pulse is generated during a runup phase of the gas discharge lamp.

2. The method as claimed in claim 1, wherein the amplitude of the current pulse and/or the profile of the current pulse and/or the duration of the current pulse and/or the time at which the current pulse is generated is/are produced as a function of at least one operational parameter of the gas discharge lamp.

3. The method as claimed in claim 2, wherein a detected lamp voltage of the gas discharge lamp and/or a detected profile of this lamp voltage are used as operational parameters.

4. The method as claimed in claim 3, wherein the amplitude of the current pulse and/or the profile of the current pulse and/or the duration of the current pulse and/or the time at which the current pulse is generated is/are produced as a function of a lamp voltage threshold value being exceeded or undershot.

5. The method as claimed in claim 1, wherein the amplitude of the current pulse and/or the profile of the current pulse and/or the duration of the current pulse and/or the time at which the current pulse is generated is/are produced such that the structures which have grown on at least one electrode are removed and the current load on an electronic ballast connected to the gas discharge lamp remains essentially unchanged.

6. The method as claimed in claim 1, wherein the duration of the current pulse is less than two seconds, in particular less than one second.

7. The method as claimed in claim 1, wherein, at least for a predeterminable duration, a peak value for the current pulse is greater than a maximum permissible current value for an electronic ballast which is electrically connected to the gas discharge lamp.

8. The method as claimed in claim 1, wherein the profile of the lamp voltage of the gas discharge lamp is detected over the duration of the current pulse, and the amplitude of the current pulse and/or the profile of the current pulse and/or the duration of the current pulse is/are generated as a function of the detected profile of the lamp voltage.

9. The method as claimed in claim 1, wherein the amplitude of the current pulse and/or the profile of the current pulse and/or the duration of the current pulse and/or the time at which the current pulse is generated is/are produced such that the rate of rise of the lamp voltage and/or the value for the lamp voltage once the duration of the current pulse has elapsed correspond to predeterminable values.

10. The method as claimed in claim 1, wherein the amplitude of the current pulse and/or the profile of the current pulse and/or the duration of the current pulse and/or the time at which the current pulse is generated is/are produced as a function of a thermal load on an electronic ballast which is electrically connected to the gas discharge lamp.

11. The method as claimed in claim 1, wherein the gas discharge lamp is fed AC voltage or alternating current, and the current pulse for the duration of in each case at least one half cycle causes structures which have grown on to melt on that electrode which is operated as the anode.

* * * * *